United States Patent [19]

Campbell

[11] Patent Number: 4,905,414

[45] Date of Patent: Mar. 6, 1990

[54] EASE "Z" THRESHOLD EMBEDDED IN CONCRETE

[76] Inventor: Lorne C. Campbell, 995 NW. 119th St., N. Miami, Fla. 33150

[21] Appl. No.: 289,244

[22] Filed: Dec. 23, 1988

[51] Int. Cl.[4] ..... E06B 1/70

[52] U.S. Cl. ..... 49/469

[58] Field of Search ..... 49/380, 467, 469, 468, 49/470, 471

[56] References Cited

U.S. PATENT DOCUMENTS

| | | | |
|---|---|---|---|
| 665,958 | 1/1901 | Dugan | 49/467 X |
| 2,909,815 | 10/1959 | Campo | 49/469 |
| 3,014,253 | 12/1961 | Manville | 49/469 |
| 4,387,535 | 6/1983 | Corbo | 49/469 X |

FOREIGN PATENT DOCUMENTS

| | | | |
|---|---|---|---|
| 3527113 | 1/1987 | Fed. Rep. of Germany | 49/467 |
| 621538 | 4/1949 | United Kingdom | 49/467 |
| 912452 | 12/1962 | United Kingdom | 49/469 |

*Primary Examiner*—James R. Brittain

[57] ABSTRACT

An improved door threshold assembly for outswinging exterior doors embedded in concrete and flush with the floor surface, assembly comprises an elongated base member having a "Z" configuration and two securing brackets and the face of the elongated base membner having a weather stripping giving a tight weather barrier when the door is in a closed position.

5 Claims, 2 Drawing Sheets

Lorne C. Campbell

LORNE C. CAMPBELL

INVENTOR

Lorne C. Campbell

LORNE C. CAMPBELL

INVENTOR

EASE "Z" THRESHOLD EMBEDDED IN CONCRETE

SUMMARY OF THE INVENTION

The present invention comprises in combination four basic components, three members comprised of metallic materials, one component comprised of rubber or a like material. Two stationary brackets are permanently affixed to the new structure and have means for securing an elongated base member of the present threshold. A weather strip extending the full horizontal width of the vertical face portion of the base member of the threshold is further incorporated. The base member of the threshold is permanently embedded in concrete flush with the floor surface.

DETAILED DESCRIPTION OF THE DRAWINGS

Figure 1:
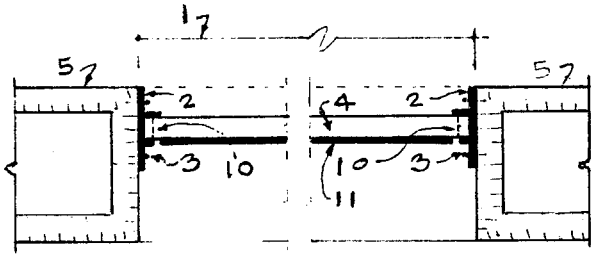
FIG. 1 is a top view of the rough opening showing the assembly of the four components which comprise the embodiment of the threshold.

FIG. 1 is a top view of the rough opening showing the complete assembly of the components which comprise the embodiment of the threshold: the rough block opening 1 indicating the opening from block to block 5 a pair of securing brackets 2 indicating a means for receiving screws or nails 3, a horizontal elongated generally Z-shaped, base member 4, two sets of parallel slotted tabs 10 on the upper and lower inner face portions of the securing brackets 2, a weather stripping 11 affixed to the vertical face portion on the horizontal elongated generally Z-shaped base member 4.

Figure 2:
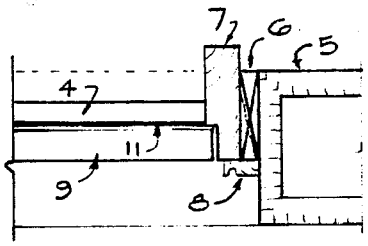
FIG. 2 shows a top view of the complete installation of the threshold and the surrounding components.

FIG. 2 showing a top view of the door components in place after complete installation of the threshold: sub jamb 6, door jamb 7, brick mold 8 indicating the door 9, elongated base member 4, weather stripping 11, and rough block 5.

Figure 3:
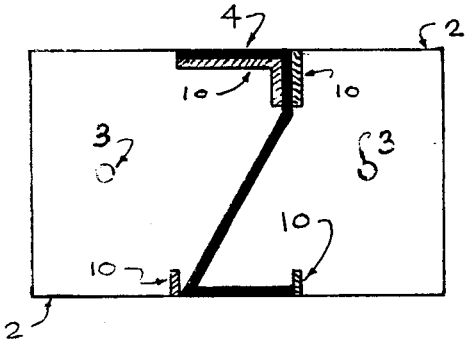
FIG. 3 shows an end view of the elongated base member in place in the right hand securing bracket.

FIG. 3 shows an end view of the elongated base member 4 in place in the right hand securing bracket 2 and further shows a means for securing in place the elongated generally Z-shaped base member 4 with two retaining tabs 10 in the upper portion and two parallel retaining tabs 10 at the lower portion on the inner face portion of the securing brackets 2.

The tabs 10 allow for alternately mounting and dismounting the base member 4 within the threshold assembly prior to embedding the assembly in concrete during the construction process.

Figure 4:
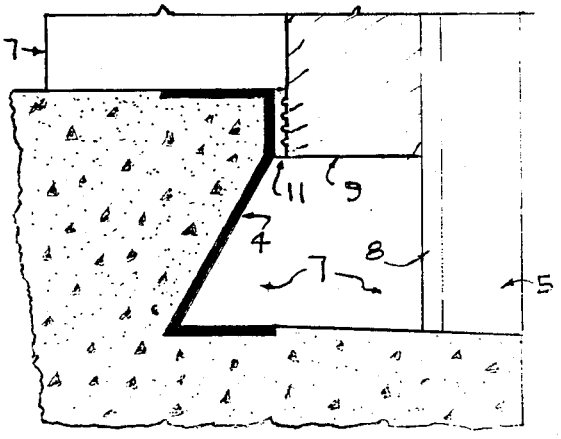
FIG. 4 shows an end view of the aforesaid base member which defines a "Z" shape configuration.

FIG. 4 shows an end view of the elongated base member 4 which defines a generally "Z" shape configuration embedded in concrete and flush with the floor surface. Door jamb 7 is shown in place with door 9, whereby the and of the door 9 is firmly butted against the weather stripping 11, forming a tight weather barrier which is permanently affixed to the vertical and horizontal faces of the elongated generally Z-shaped base member 4. The brick mold 8 and the block wall 5 are further shown.

As shown in FIGS. 3 and 4, the generally Z-shaped base member 4 has a flat horizontal top segment, a flat vertical front segment extending down from the top segment at its front edge, a flat inclined segment extending downwardly and rearwardly from the lower edge of the vertical front segment, and a flat horizontal bottom segment extending forward from the lower edge of the inclined segment. The lower rear corner where the inclined segment is joined to the bottom segment is substantially vertically aligned with the rear edge of the top segment. The front edge of the bottom segment is substantially vertically aligned with the front face of the vertical front segment.

Figure 5:
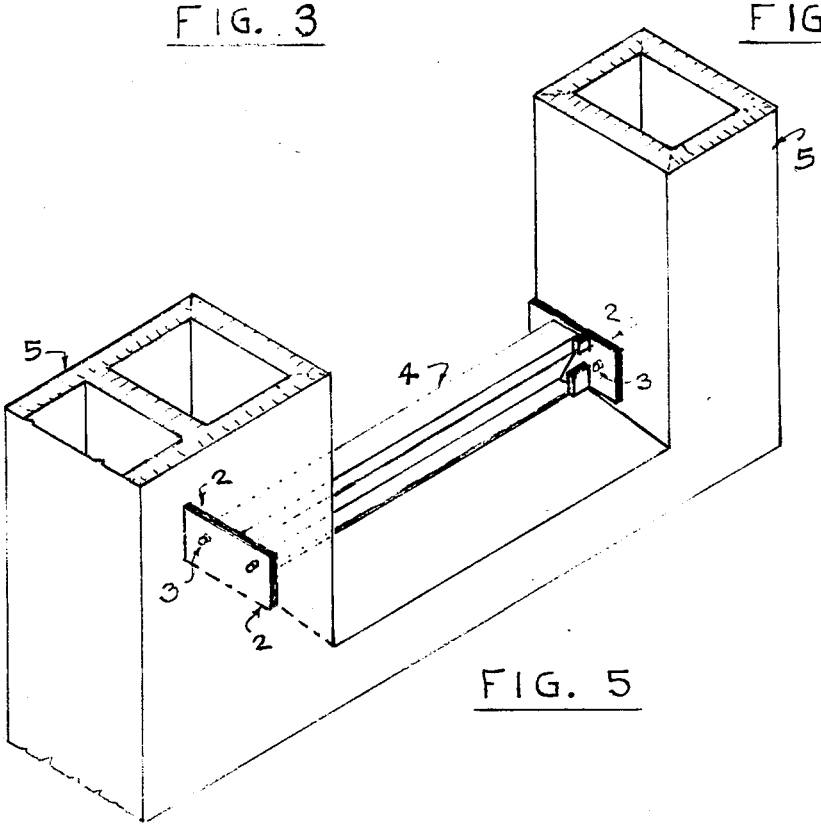
FIG. 5 is a perspective view of the embodiment of the threshold shown joined with the two securing brackets assembled and in place.

FIG. 5 shows a perspective view of the embodiment of the threshold wherein the elongated generally Z-shaped base member 4 is shown joined with the two securing brackets 2 and having a means for securing to the rough opening screw or nail holes 3.

Figure 6:
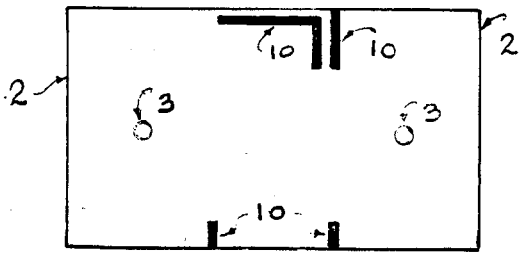
FIG. 6 shows the inner face of a securing bracket with the upper portion retaining tabs and the lower portion retaining tabs.

FIG. 6 shows the inner face of a securing bracket 2 with the upper portion retaining tabs 10 and the lower portion retaining tabs 10 wherein the lower portion retaining tabs are offset to the left with respect to the upper portion retaining tabs 10. Further shown are two holes 3 as a means for affixing the securing brackets 2.

Figure 7:
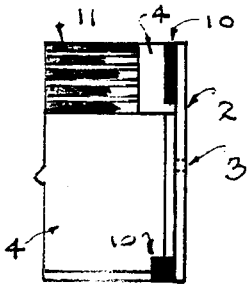
FIG. 7 is a front right side sectional view showing the threshold in place.

FIG. 7 is a front right side sectional view showing the threshold in place with the securing bracket 2 and the upper and lower retaining tabs 10 in place. The weather stripping 11 is shown affixed in place to the vertical face portion on the horizontal elongated generally Z-shaped base member 4 and screw holes 3 are indicated.

Figure 8:
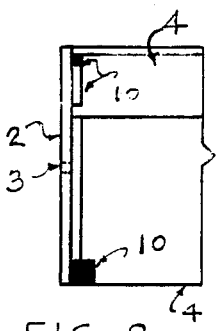
FIG. 8 shows a reverse right side sectional view of FIG. 7.

FIG. 8 shows a reverse right side sectional view of FIG. 7 showing the components 2,3,4 and 10.

Figure 9:
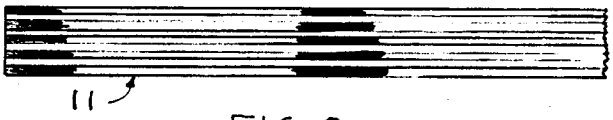
FIG. 9 shows a means for weather proofing the assembly.

FIG. 9 shows a front view of the weather stripping 11.

Figure 10:
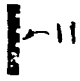
FIG. 10 is a side view of the aforesaid means for weather proofing the assembly.

FIG. 10 shows a side view of the weather stripping .

Figure 11:
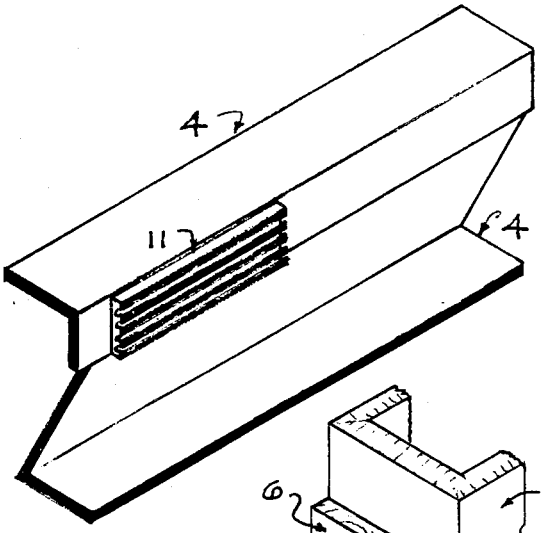
FIG. 11 shows a perspective view of the base member shown with the aforesaid means for weather proofing affixed in place.

FIG. 11 shows a perspective view of the horizontal elongated generally Z-shaped base member 4 further shown with the weather stripping 11 affixed to the vertical and horizontal face portions of the base member.

Figure 12:
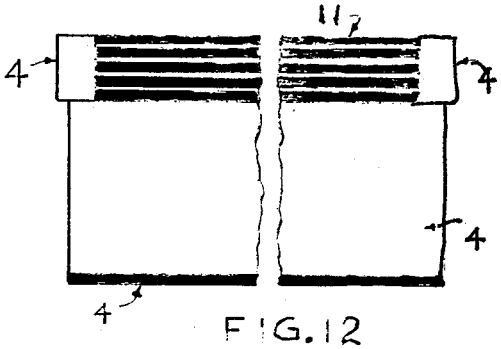
FIG. 12 shows the front view of the base member indicating the lower portion of the base member having a substantially narrower width permitting ease of installation.

FIG. 12 shows an additional front view of the base member 4 and the weather stripping 11 giving a truer perspective and indicating the lower portion of the base member 4 having a substantially narrower width permitting ease of installation.

Figure 13:
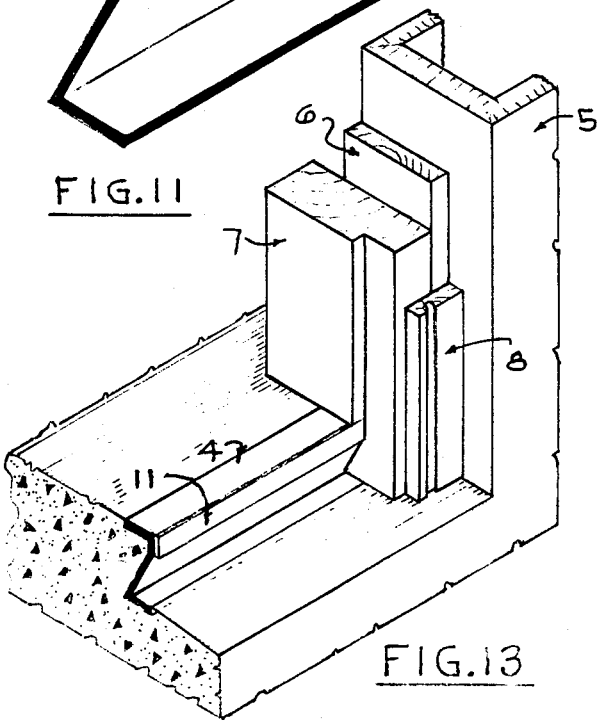
FIG. 13 shows a complete and finished perspective view of the components and threshold embedded in concrete.

FIG. 13 shows a complete and finished perspective view of the components and the threshold embedded in concrete with the top portion flush with the finished floor and the bottom portion flush with the lower sill. The concrete block 5, sub jamb 6, finished door jamb 7, brick mold 8, and the weather stripping 11 are shown affixed in place to the face portion of the generally Z-shaped elongated base member 4.

Figure 14:
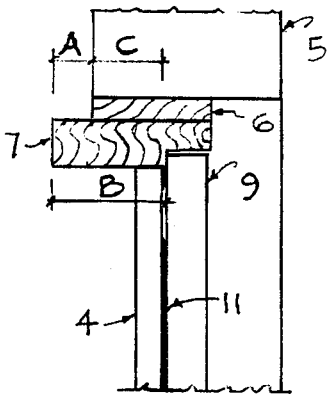
FIG. 14 is a top and right side view indicating the positions and locations of the embodying components.

FIG. 14 is a top and right side view indicating the positions and locations of the embodying components "A" indicates the variance between the block walls 5 and edge of door jamb 7 for plaster or dry wall and a variance allowing for the face of jamb 7 and "B" having a correlation with "A" and "C" whereas "B" minus "A" equals "C". Base member 4, concrete block 5, sub jamb 6, door jamb 7, door 9 and weather stripping 11 are further shown.

What is claimed as new:

1. A threshold assembly for a doorway having opposite sides, said threshold assembly comprising:

an elongated one-piece base member of generally Z-shaped cross-section having a substantially horizontal top segment with front and rear edges, a substantially vertical front segment extending down from said top segment, said front segment having an upper edge joined to said front edge of said top segment and a lower edge spaced below its upper edge, a horizontally thin inclined segment extending downwardly and rearwardly from said lower edge of said front segment, said inclined segment having a lower edge spaced below and behind said lower edge of said front segment, said lower edge of said inclined segment segment being substantially vertically aligned with said rear edge of said top segment, and a substantially horizontal bottom segment extending forward from said lower edge of said inclined segment, said bottom segment having a rear edge joined to said lower edge of said inclined segment and a front edge substantially vertically aligned with said front edge of said top segment;

a weatherstrip member affixed to the front of said front segment of the base member;

and brackets snugly receiving the opposite ends of said base member, said brackets being attachable to the opposite sides of the doorway.

2. A threshold assembly for a doorway having opposite sides, said threshold assembly comprising:

an elongated one-piece base member of generally Z-shaped cross-section having a substantially horizontal top segment with front and rear edges, a substantially vertical front segment extending down from said top segment, said front segment having an upper edge joined to said front edge of said top segment and a lower edge spaced below its upper edge, an inclined segment extending downwardly and rearwardly from said lower edge of said front segment, said inclined segment having a lower edge spaced below and behind said lower edge of said front segment, and a substantially horizontal bottom segment extending forward from said lower edge of said inclined segment;

a weatherstrip member affixed to the front of said front segment of the base member;

and brackets snugly receiving the opposite ends of said base member, said brackets being attachable to the opposite sides of the doorway;

said top and front segments of said base member projecting beyond the opposite ends of said inclined and bottom segments.

3. A threshold assembly for a doorway having opposite sides, said threshold assembly comprising:

an elongated one-piece base member of generally Z-shaped cross-section having a substantially horizontal top segment with front and rear edges, a substantially vertical front segment extending down from said top segment, said front segment having an upper edge joined to said front edge of said top segment and a lower edge spaced below its upper edge, an inclined segment extending downwardly and rearwardly from said lower edge of said front segment, said inclined segment having a lower edge spaced below and behind said lower edge of said front segment, and a substantially horizontal bottom segment extending forward from said lower edge of said inclined segment;

a weatherstrip member affixed to the front of said front segment of the base member;

and brackets snugly receiving the opposite ends of said base member, said brackets being attachable to the opposite sides of the doorway;

said brackets at each of said opposite ends of said base member comprising an upper bracket slidably receiving said top and front segments of said base member, and a lower bracket slidably receiving said bottom segment of said base member.

4. A threshold assembly according to claim 3 wherein:

said upper bracket engages beneath said top segment of said base member and engages said front segment of said base member at the front and rear thereof;

and said lower bracket extends behind and in front of said bottom segment of said base member.

5. A threshold assembly according to claim 4 wherein said top and front segments of said base member project beyond the opposite ends of said inclined and bottom segments.

* * * * *